US007753366B2

(12) United States Patent
Kawanishi et al.

(10) Patent No.: US 7,753,366 B2
(45) Date of Patent: Jul. 13, 2010

(54) SHEET FEEDING APPARATUS AND IMAGE FORMING APPARATUS WITH SHEET FEEDING APPARATUS THEREIN

(75) Inventors: Minoru Kawanishi, Sunto-gun (JP); Akira Matsushima, Sunto-gun (JP); Masaki Iwase, Sunto-gun (JP); Yasuhiro Uchida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 176 days.

(21) Appl. No.: 11/437,725

(22) Filed: May 22, 2006

(65) Prior Publication Data

US 2006/0269349 A1 Nov. 30, 2006

(30) Foreign Application Priority Data

May 25, 2005 (JP) ..... 2005-152755

(51) Int. Cl.
*B65H 9/16* (2006.01)
*B65H 9/04* (2006.01)

(52) U.S. Cl. ..... 271/153; 271/152

(58) Field of Classification Search ..... 271/152, 271/153, 162, 155, 154, 130, 38, 31, 25, 271/110, 111, 126, 127
See application file for complete search history.

(56) References Cited

U.S. PATENT DOCUMENTS 4,888,617 A * 12/1989 Okuzawa ..... 355/400
5,016,864 A * 5/1991 Nonami ..... 271/38
5,100,122 A * 3/1992 Noda et al. ..... 271/155
5,207,416 A * 5/1993 Soler ..... 271/31
5,624,108 A * 4/1997 Kubo ..... 271/9.12
5,678,814 A * 10/1997 Yokoyama et al. ..... 271/9.05
5,897,112 A * 4/1999 Kwag ..... 271/38
5,918,873 A 7/1999 Saito et al. ..... 271/10.11
5,988,629 A * 11/1999 Burlew et al. ..... 271/152
6,302,389 B1 10/2001 Kato et al. ..... 270/58.13
6,305,682 B1 10/2001 Saito et al. ..... 271/10.11
6,308,951 B1 10/2001 Allmendinger et al. 271/265.04

(Continued)

FOREIGN PATENT DOCUMENTS

DE 10 2005 043528 4/2006

(Continued)

OTHER PUBLICATIONS

Translation of Russian Official Action issued in Russian Application No. 2006117886/09(019458).

*Primary Examiner*—Patrick Mackey
*Assistant Examiner*—Patrick Cicchino
(74) *Attorney, Agent, or Firm*—Fitzpatrick, Cella, Harper & Scinto

(57) ABSTRACT

The sheet feeding apparatus includes a sheet stack tray on which sheets to be fed are stacked, a drive motor for moving up the sheet stack tray, a detection sensor for detecting the position of an uppermost sheet stacked on the sheet stack tray, and a control part for controlling the function of the drive motor, wherein, when the detection sensor detects that the uppermost sheet reaches a predetermined height while the drive motor executes a drive so as to move up the sheet stack tray, the control part tentatively stops or decelerates the drive motor and thereafter drives the drive motor so as to move up the sheet stacked on the sheet stack tray to a feed position.

6 Claims, 8 Drawing Sheets

U.S. PATENT DOCUMENTS

| | | | | |
|---|---|---|---|---|
| 6,422,773 | B1 * | 7/2002 | Lim | 400/710 |
| 6,695,305 | B2 * | 2/2004 | Muller et al. | 271/152 |
| 7,147,218 | B2 | 12/2006 | Izumi et al. | 271/145 |
| 2002/0081124 | A1 | 6/2002 | Kuwata et al. | 399/107 |
| 2002/0130459 | A1 * | 9/2002 | Herrmann | 271/10.11 |
| 2004/0195757 | A1 * | 10/2004 | Lyu et al. | 271/110 |
| 2005/0087921 | A1 * | 4/2005 | Aoki et al. | 271/126 |
| 2005/0236760 | A1 * | 10/2005 | Kang | 271/152 |
| 2006/0012107 | A1 | 1/2006 | Ueda et al. | 271/98 |
| 2006/0157915 | A1 * | 7/2006 | Ogawa | 271/126 |
| 2007/0069450 | A1 | 3/2007 | Kawanishi et al. | 271/162 |
| 2008/0001342 | A1 * | 1/2008 | Matsushima et al. | 271/3.14 |

FOREIGN PATENT DOCUMENTS

| | | | |
|---|---|---|---|
| EP | 0 798 246 | A1 | 10/1997 |
| EP | 1013582 | | 6/2000 |
| GB | 1 535 474 | | 12/1978 |
| JP | 61-277521 | | 12/1986 |
| JP | 03-23120 | | 1/1991 |
| JP | 4-277138 | | 10/1992 |
| JP | 8-169568 | | 7/1996 |
| JP | 10-231029 | | 9/1998 |
| JP | 11-268858 | | 10/1999 |
| JP | 2000-219409 | | 8/2000 |
| JP | 2001-310826 | * | 11/2001 |
| JP | 2001310826 | * | 11/2001 |
| RU | 2157332 | | 10/2000 |

* cited by examiner

SHEET FEEDING APPARATUS AND IMAGE FORMING APPARATUS WITH SHEET FEEDING APPARATUS THEREIN

BACKGROUND OF THE INVENTION

1. Field of the Invention

The present invention relates to a sheet feeding apparatus for feeding sheets, and an image forming apparatus equipped with the same.

2. Related Background Art

A sheet feeding apparatus connected to or equipped in an image forming apparatus such as a printer, a copying apparatus or a facsimile apparatus is generally so constructed that plural sheets stacked on a sheet stack tray are elevated to a predetermined position, and are separated and fed one by one from the uppermost one for example by a feed roller.

Also a widely utilized apparatus employs a DC motor as a power source for elevating the sheet stack tray, and is equipped with height detection means for the sheet stack tray or the sheets, for detecting the height of the sheet stack tray or the uppermost sheet stacked thereon, in order to maintain the sheet stack tray at an optimum height relative to the feeding roller.

There is also known, as disclosed in Japanese Patent Application Laid-open No. H10-231029, an apparatus employing a stepping motor as the power source for the sheet stack tray and equipped with height detection means for detecting the height of the sheet stack tray, and adapted to vary a current supplied to the stepping motor as the power source or a revolution thereof by means of a detection signal of the height detection means.

In such prior structures, however, when an inexpensive DC motor is employed as the power source, the number rotations of such DC motor varies as shown in FIG. 6, depending on an amount (weight) of the sheets stacked on the sheet stack tray.

FIG. 6 shows a number of rotations of the DC motor per unit time (hereinafter simply referred to as "rotation number") in the ordinate, as a function of a load torque of the DC motor corresponding to a sheet stacking amount in the abscissa.

According to FIG. 6, the rotation number of the DC motor increases as the sheet stacking amount on the sheet stack tray decreases.

Therefore, in case a small amount of sheets is stacked on the sheet stack tray, when the sheet stack tray is elevated and the DC motor is stopped after detecting that the uppermost sheet reaches the predetermined height, the uppermost sheet on the sheet stack tray is elevated to a position higher than the predetermined feed position. Stated differently, the sheet stack tray causes an overrun in case a small amount of sheets is stacked thereon.

This is because the rotation number of the DC motor increases for a small sheet stack amount, and, as a result, the height of the stacked sheets becomes higher than the predetermined height for sheet feeding.

In such situation where the uppermost sheet is stopped at a position higher than the predetermined feed position, the sheet may impinge on the feed roller at the feeding operation, thereby causing a jam and hindering an appropriate sheet feeding operation.

In order to suppress a fluctuation in the overrun of the sheet stack tray, Japanese Patent Application Laid-open No. H03-23120 discloses a constitution in which the movement of the sheet stack tray is switched up, down, up and down at timings when the output of a detection sensor for detecting the uppermost sheet position is turned off, on, off and on. In such constitution, since the once elevated sheet stack tray is then lowered and then elevated again, there is required a longer time until the sheet stack tray is stopped at the predetermined position and becomes ready for sheet feeding.

On the other hand, an apparatus utilizing a stepping motor for the power source is costly because the stepping motor is more expensive in comparison with the DC motor.

SUMMARY OF THE INVENTION

The present invention has been made in consideration of such situation, and an object thereof is provide a sheet feeding apparatus capable of preventing a feeding failure by an overrun of a sheet stack tray even when a small amount of sheets is stacked thereon, thereby realizing a stable feeding performance at a low cost, and an image forming apparatus equipped with such sheet feeding apparatus.

Another object of the present invention is to provide a sheet feeding apparatus comprising a sheet stack tray movable up and down, wherein sheets to be fed are stacked on said sheet stack tray; a drive motor for moving said sheet stack tray up; a detection sensor for detecting a position of an uppermost sheet stacked on said sheet stack tray; and a control part for controlling a function of the drive motor based on a result of detection by said detection sensor, wherein, when the detection sensor detects that the uppermost sheet reaches a predetermined height while the drive motor drives to move said sheet stack tray up, said control part effects a tentative stop or a speed reduction of said drive motor and, after the tentative stop or the speed reduction, drives said drive motor to move up said sheet stacked on the sheet stack tray to a feed position.

A further object of the present invention will become fully apparent from the following description to be taken in conjunction with the accompanying drawings.

DETAILED DESCRIPTION OF THE PREFERRED EMBODIMENTS

In the following, embodiments of a sheet feeding apparatus of the present invention and of an image forming apparatus equipped with such sheet feeding apparatus will be explained with reference to the accompanying drawings.

In these embodiments, however, dimensions, materials, shapes and relative arrangement of components are not to be construed as to limit the scope of the invention to such embodiments, unless specified otherwise.

In the following, there will be explained an embodiment in which a sheet feeding apparatus of the present invention is applied to a laser beam printer (hereinafter called image forming apparatus) of electrophotographic process.

Figure 2:
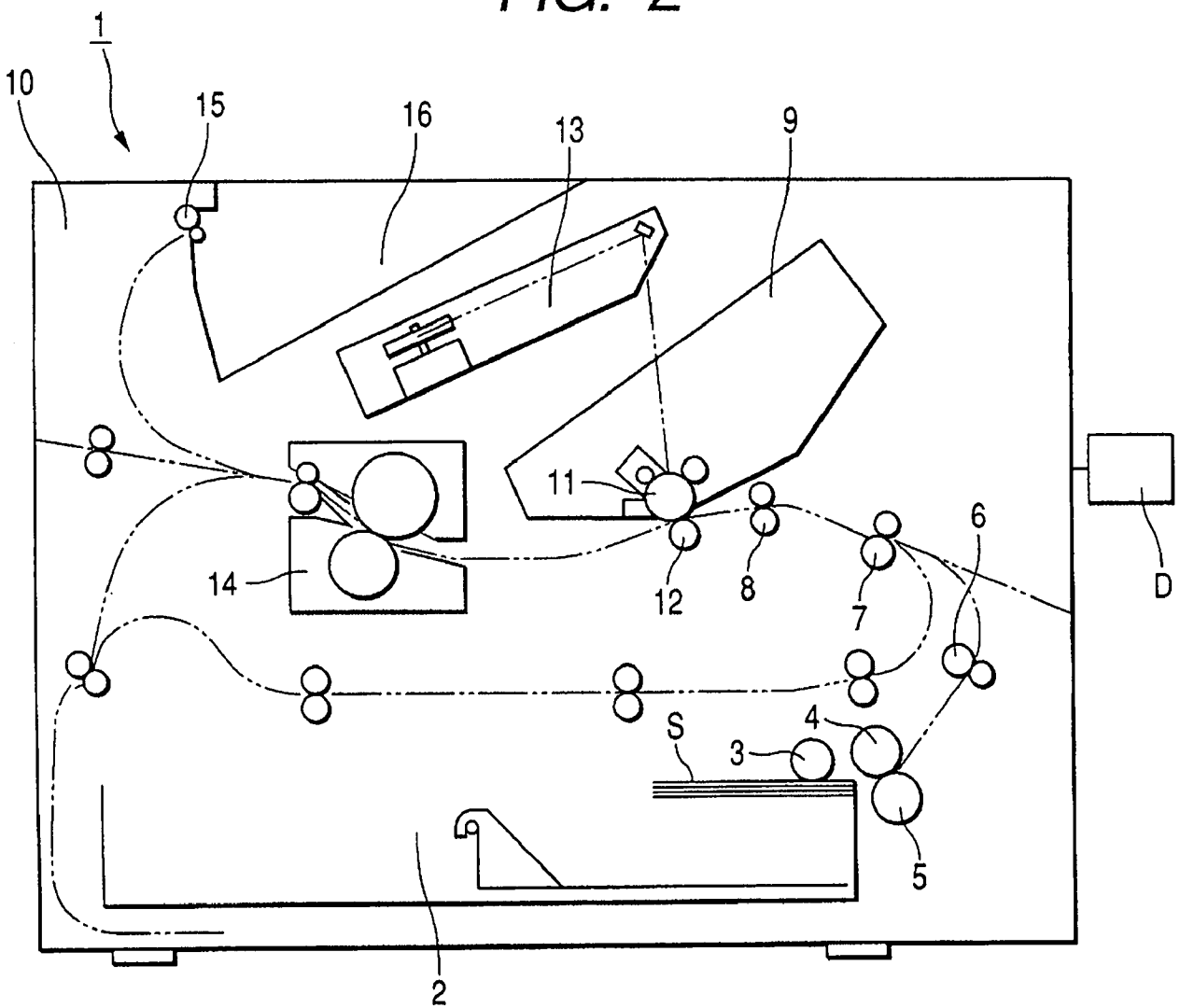
FIG. 2 is a schematic cross-sectional view showing a structure of an image forming apparatus equipped with a sheet feeding apparatus.

FIG. 2 is a cross-sectional view of an image forming apparatus equipped with a sheet feeding apparatus of the present embodiment.

The image forming apparatus 1 is provided with a main body 10 of the image forming apparatus and a sheet cassette 2 provided in a lower part of the image forming apparatus and serving as sheet container means for stacking and storing sheets. The sheet cassette 2 is detachably mounted on a front side (front side relative to the plane of FIG. 2) of the image forming apparatus 1. The main body 10 of the image forming apparatus is provided with a pickup roller 3 which selectively advances sheets S, contained in the sheet cassette 2, from the uppermost sheet, a feed roller 4 and a retard roller 5. The feed roller 4 and the retard roller 5 serve to one by one separate and feed sheets advanced by the pickup roller 3.

The main body 10 of the image forming apparatus is provided with a pair of conveying rollers 6, 7 and a pair of registration rollers 8. The pair of conveying rollers 6, 7 receives the sheets S fed by the feed rollers 4 and conveys them toward the pair of registration rollers 8 sequentially. The sheet S conveyed by the pair of conveying rollers 7 is made to impinge, at a leading end, on a nip portion of the pair of registration rollers, in a tentatively stopped state, thereby forming a loop and being corrected from skewing. Then the pair of registration rollers 8 conveys the sheet S, at a predetermined timing, to a nip portion a photosensitive drum 11 constituting image forming means incorporated a process cartridge 9 therein, and a transfer roller 12 opposed thereto.

The process cartridge 9, incorporating known process means of the image forming apparatus 1, is detachably mounted on the main body 10 of the image forming apparatus. The main body 10 is also provided with a laser exposure optical system 13, which irradiates a uniformly charged surface of the photosensitive drum 11 with a laser light modulated according to image information, thereby forming an electrostatic latent image on the surface of the photosensitive drum 11.

Then, an unillustrated developing roller incorporated in the process cartridge 9 develops the electrostatic latent image into a toner image. Then, in synchronization with the rotation of the photosensitive drum 11, the sheet S is conveyed by the pair of registration rollers 8 to the nip portion between the photosensitive drum 11 and the transfer roller 12, whereby the toner image formed on the photosensitive drum 11 is transferred onto the sheet S, by means of the transfer roller 12.

The main body 10 of the image forming apparatus is provided with a fixing apparatus 14. The fixing apparatus 14 executes, when the sheet S bearing the transferred toner image passes, a process of heating and pressurizing the toner image thereby permanently fixing the toner image onto the sheet S. The sheet S, bearing the toner image fixed by the fixing apparatus 14, is conveyed by a pair of discharge rollers 15 and is discharged onto a discharge tray 16, formed on an upper surface of the image forming apparatus 1.

In the following, structure and operations of the sheet feeding apparatus will be explained in detail.

Figure 3:
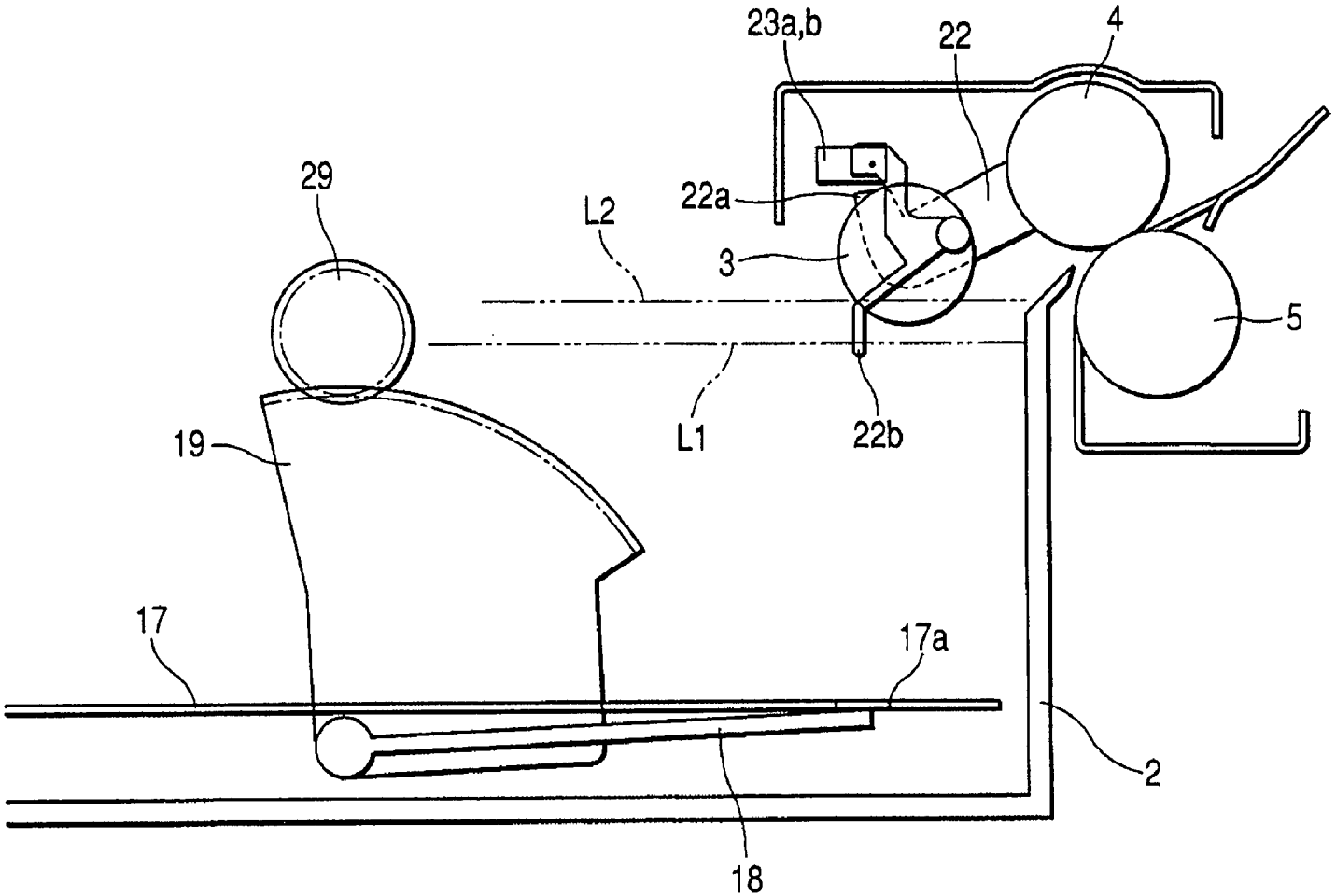
FIG. 3 is a cross-sectional view showing a structure of a sheet stack tray.

At first the structure of the sheet feeding apparatus will be explained with reference to FIG. 3 which is a cross-sectional view showing the structure of the sheet feeding apparatus. The sheet feeding apparatus is provided with a sheet stack tray 17 for stacking sheets to be fed, drive means 20, a detection sensor 23, a control part 30 and an informing part.

The sheet stack tray 17 is provided rotatably (vertically movably) in the sheet cassette 2. The sheet stack tray 17 is provided with a Through hole 17*a*, for receiving a lower end portion of a sheet presence/absence flag 22*b* to be explained later.

The drive means 20 includes a lift arm 18, a lift gear 19, a gear 29, a lift motor 24 serving as a driving motor, a worm gear 25 and gears 26, 27, 28. The lift motor 24 is constituted of a DC motor. The lift arm 18 is fixed to the lift gear 19 at a lower part of the sheet stack tray 17. The lift gear 19 meshes with the gear 29, and the lift arm 18 and the lift gear 19 are rendered pivotable by the rotation of the gear 29.

Figure 8:
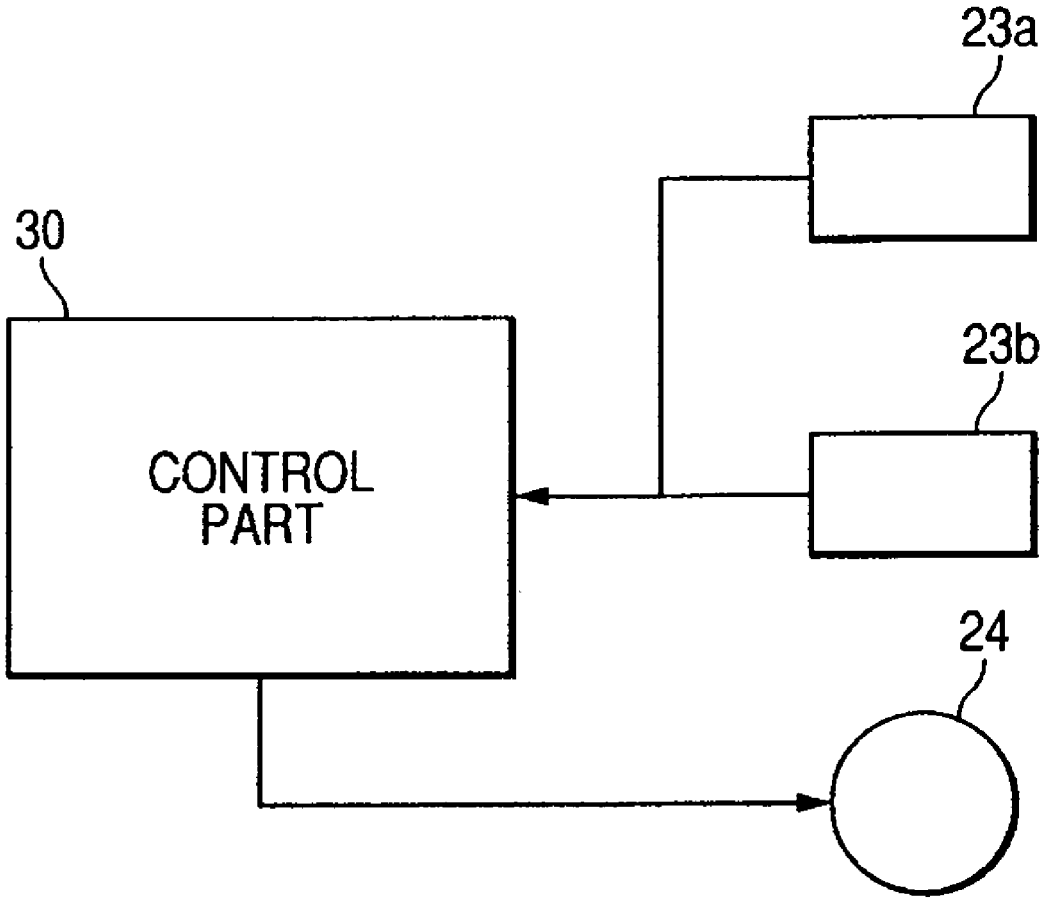
FIG. 8 is a block diagram showing a control block in the embodiment 1.

The detection sensor 23 includes a sheet height sensor 23*a*, and a sheet presence/absence detection sensor 23*b*. The control part 30 constituting control means, as shown in a block diagram in FIG. 8, is electrically connected to the sheet height detection sensor 23*a* and the sheet presence/absence detection sensor 23*b*, constituting the detection sensor 23, and to the lift motor 24, thereby transmitting a command to the lift motor 24 based on the detection result of the detection sensor 23.

The notifying part, for example a display panel D, for example indicates that a sheet is not stacked on the sheet stack tray 17.

Figure 4:
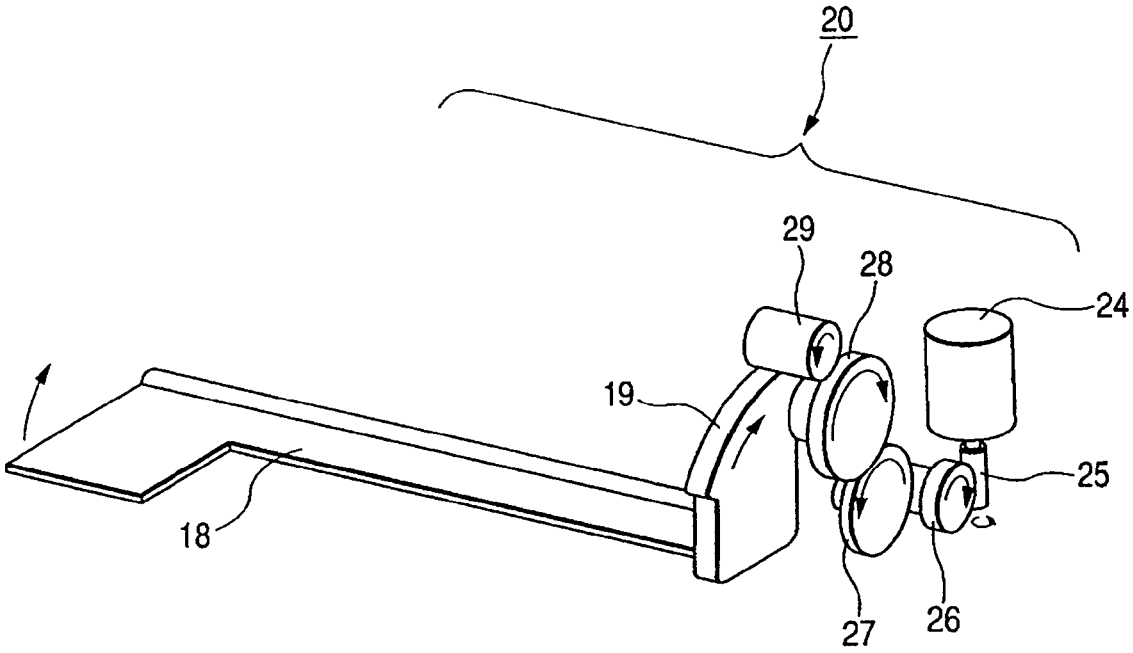
FIG. 4 is a perspective view showing a gear train of a lift motor.

The mechanism for vertically moving the sheet stack tray 17 will be explained. FIG. 4 is a perspective view showing a gear train of the lift motor 24. The worm gear 25 is mounted on a driving shaft of the lift motor 24 and meshes with the gear 26, which in turn meshes with the gear 27, meshing in turn with the gear 28, whereby the revolution of the lift motor 24 is reduced.

In the present embodiment, the lift motor 24, the worm gear 25 and the gears 26, 27, 28 are mounted in the image forming apparatus 1, and the gears 28 and 29 are connected when the sheet cassette 2 is mounted on the image forming apparatus 1.

When the gears 28, 29 are connected, the driving power of the lift motor 24 is transmitted to the gear 29, thereby pivoting the lift gear the lift arm 18 fixed thereto. The pivoting motion of the lift arm 18 pushes up the sheet stack tray 17 thereby causing an elevation thereof.

The detection sensor 23 constitutes parts of the sheet height detection means and the sheet presence/absence detection means. The sheet height detection means includes a sheet height detection sensor 23*a* and a sheet height detection flag 22*a*. The sheet presence/absence detection means includes a sheet presence/absence detection sensor 23*b* and a sheet presence/absence flag 22*b*. The sheet height detection means and the sheet presence/absence detection means will be explained with reference to FIG. 5.

The feed roller 4 and the pickup roller 3 are connected by a pickup arm 22, and the pickup roller 3 is rendered pivotable about the feed roller 4. The pickup arm 22 is provided, at an end opposite to the feed roller 4, with the sheet height detection flag 22*a*, and the sheet height detection sensor 23*a* is turned on when the sheet height detection flag 22*a* intercepts the light thereto, thereby detecting the height of the sheets S stacked on the sheet stack tray 17.

Also sheet presence/absence detection sensor 23*b* is turned on when the sheet presence/absence flag 22*b* transmits the light thereto, thereby detecting presence/absence of the sheet S stacked on the sheet stack tray 17.

The sheet height detection sensor 23*a* and the sheet presence/absence detection sensor 23*b* are provided in different positions along a depth direction of the drawing.

A sheet presence/absence detection position L1 is a contact height between a lower end portion of the sheet presence/absence flag 22*b* and the sheet stack tray 17 at a timing of an on/off switching of the sheet presence/absence detection sensor 23*b*. The sheet presence/absence detection sensor 23*b*, which is a detection sensor, detects whether an uppermost sheet on the sheet stack tray 17 has reached the predetermined sheet presence/absence detection position L1.

Figure 5:
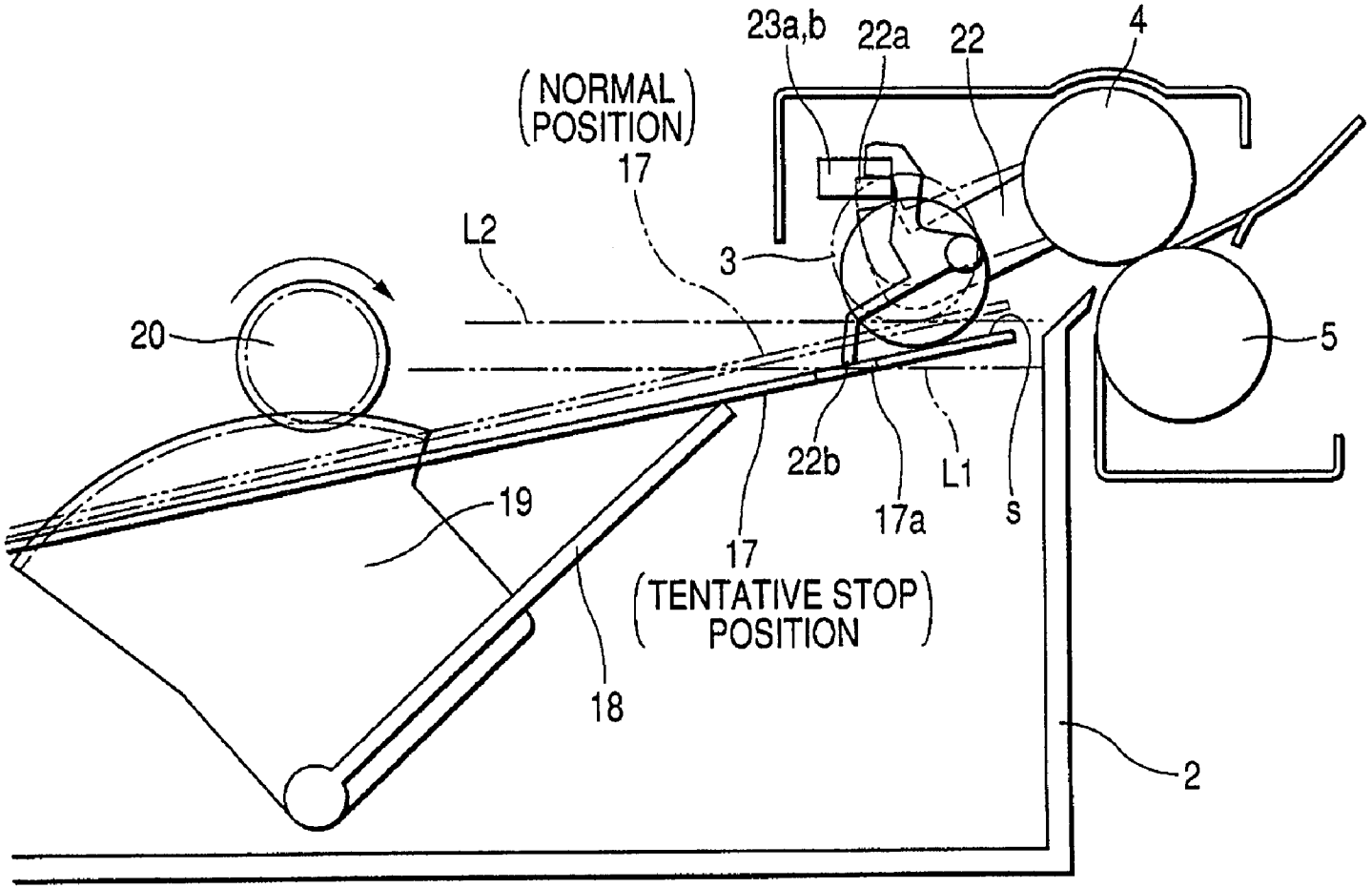
FIG. 5 is a cross-sectional view showing a sheet height detection mechanism and a sheet presence/absence detection mechanism.
Figure 6:
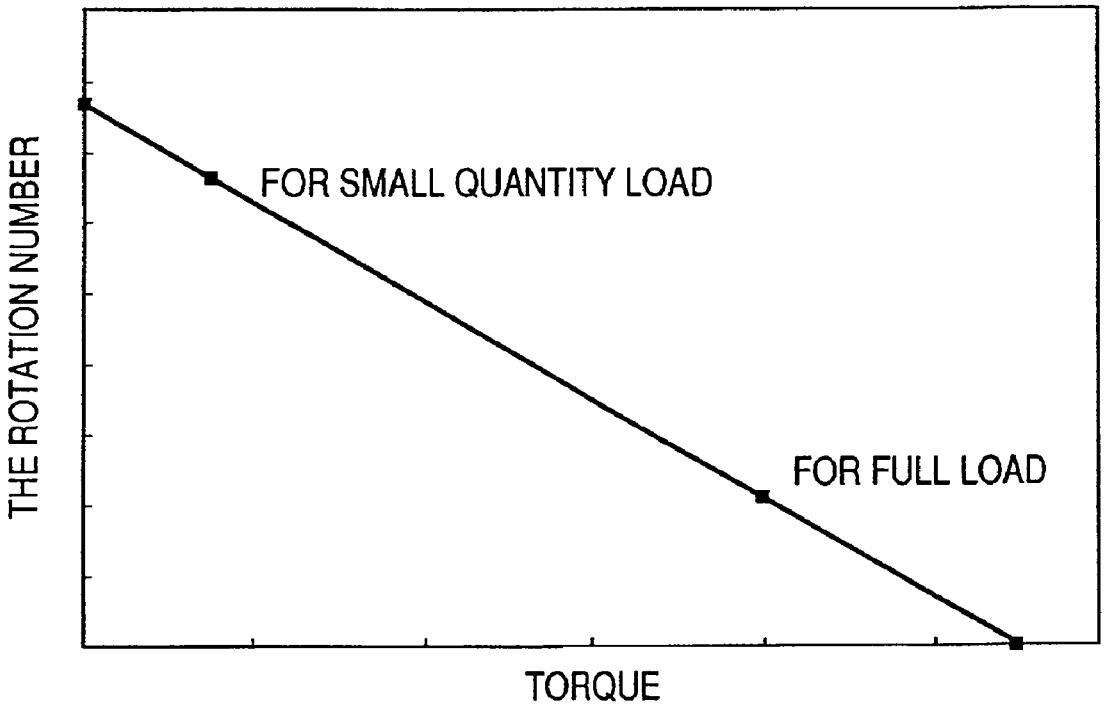
FIG. 6 is a chart showing a torque-rotation number relationship of the lift motor.

A sheet height detection position L2 is a contact height between the pickup roller 3 and the sheet stack tray 17 at a timing of on/off switching of the sheet height detection sensor 23*a* (cf. FIG. 5). The sheet presence/absence detection position L1 is positioned lower than the sheet height detection position L2. The sheet height detection position L2 corresponds to a feed position for feeding a sheet by the pickup roller 3, when the sheet is stacked on the sheet stack tray 17. The sheet height sensor 23*a*, which is a height detection sensor, detects whether the uppermost sheet on the sheet stack tray 17 has reached the feed position.

The sheet presence/absence flag 22*b* contacts with the upper surface of the sheet S stacked on the sheet stack tray 17, pivoting about the feed roller 4. The sheet stack tray 17 is provided with the through hole 17*a* in a position at which the end of the sheet presence/absence flag 22*b* contacts assuming that the sheet presence/absence flag 22*b* pivots in the absence of a sheet on the sheet stack tray 17. Thus, in case the sheet S is present on the sheet stack tray 17 and when the uppermost sheet thereon comes higher than the predetermined position by move-up of the sheet stack tray 17, the sheet presence/absence flag 22*b* contacts the upper surface of the sheet S and pivots about the feed roller 4, thereby transmitting or intercepting the light to the sheet presence/absence detection sensor 23*b* and switching on/off state thereof. On the other hand, in the absence of a sheet on the sheet stack tray 17, even when the sheet stack tray 17 is moved up, the sheet presence/absence flag 22*b* enters the through hole 17*a* and does not move, thereby not executing transmission or interception of the light to the sheet presence/absence detection sensor 23*b*, of which on/off state is therefore not switched. The sheet presence/absence detection position L1 is a position for judging whether the sheet presence/absence flag 22*b* pivots in contact with the upper surface of the sheet S.

The sheet height detection flag 22*a* rotates about the feed roller 4, by a movement of the pickup roller 3 in contact with the upper surface of the sheet S on the sheet stack tray 17. The sheet presence/absence flag 22*b* contacts, earlier than the sheet height detection flag 22*a*, the sheet S stacked on the sheet stack tray 17. In case the sheet presence/absence flag 22*b* enters the Through hole 17*a* when the sheet stack tray 17 is moved up, because of the absence of the sheet thereon, the sheet height detection flag 22*a* does not move as the pickup roller 3 is not pushed up by the upper surface of the sheet S on the sheet stack tray 17. When, in the presence of the sheet S on the sheet stack tray 17, the sheet presence/absence flag 22*b* in contact with the upper surface of the sheet S pivots about the feed roller 4, the sheet presence/absence flag 22*b* moves at first and then the sheet height detection flag 22*a* moves from a position where the pickup roller 3 is in contact with the upper surface of the sheet S on the sheet stack tray 17. A position where the pickup roller 3 is in contact with the upper surface of the sheet S on the sheet stack tray 17 and pushes up the sheet height detection flag 22*a* becomes the feed position.

Thus, the sheet height detection flag 22*a* is moved, when the upper surface of the sheet S on the sheet stack tray 17 reaches the feed position and pushes up the pickup roller 3, to execute transmission or interception of the light to the sheet height detection sensor 23*a* thereby causing an on/off operation thereof. As a result, in the presence of the sheet S on the sheet stack tray 17, when the uppermost sheet reaches the feed position by move-up of the sheet stack tray 17, the sheet height detection flag 22*a* starts to move thereby switching the on/off state of the sheet height detection sensor 23*a*.

Figure 1:
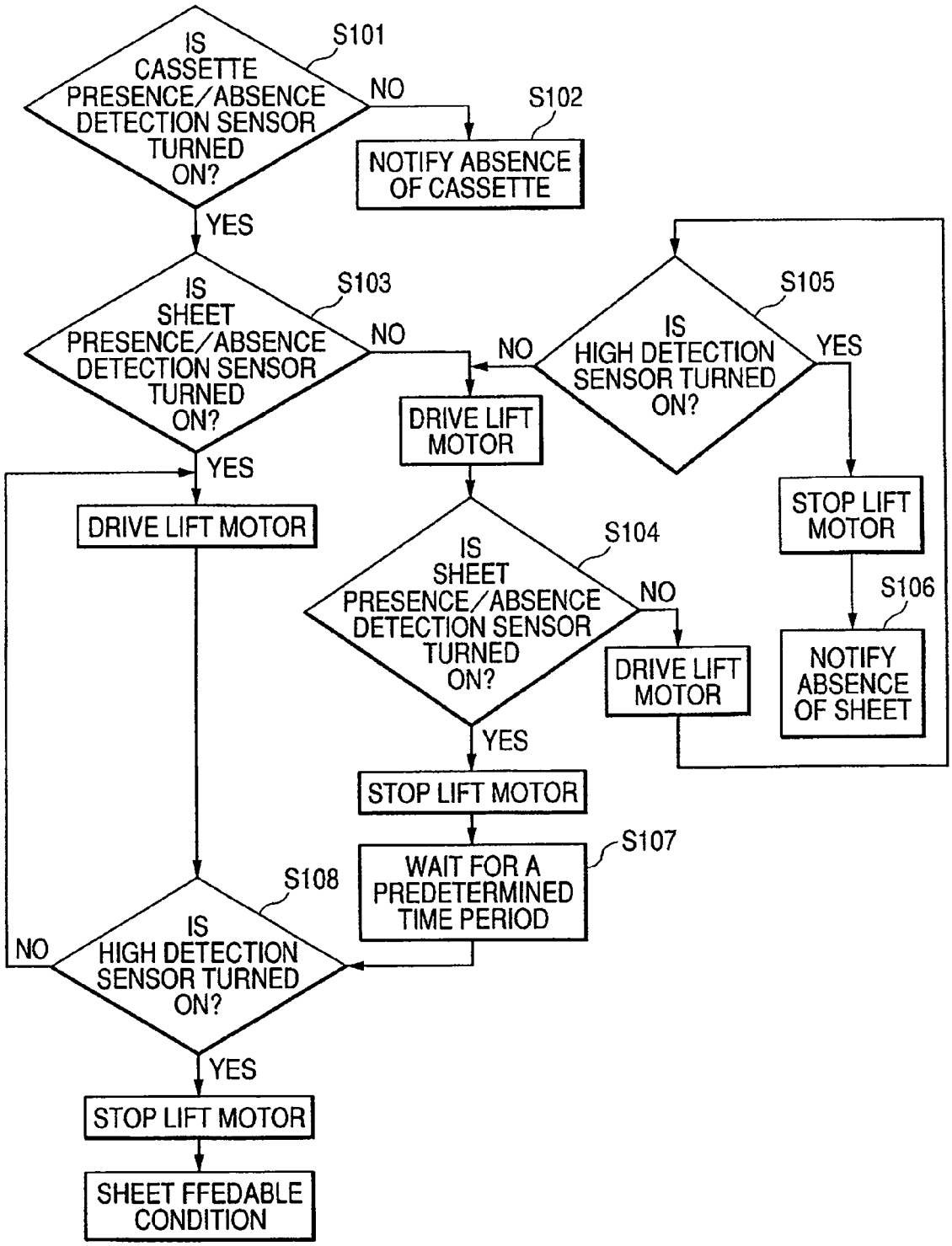
FIG. 1 is a flow chart showing a control sequence for an operation (lift) mechanism of a sheet stack tray of an embodiment 1.

In the following, the control of the up/down operation of the sheet stack tray 17 will be explained with reference to a flow chart shown in FIG. 1.

When the sheet cassette 2 is inserted into the image forming apparatus 1, an unillustrated sheet cassette sensor detects the sheet cassette 2 (step S101). In case the sheet cassette 2 is not detected (in case the sheet cassette sensor is off), an absence of the cassette is notified (step S102).

Then sheet presence/absence detection sensor 23*b* detects whether a sheet S is present (step S103), namely whether an uppermost sheet S is higher than the sheet presence/absence detection position L1. In case the sheet presence/absence detection sensor 23*b* is in an on-state, the lift motor 24 is activated to move up the sheet to a height where the sheet height detection sensor 23*a* is turned on (step S108). The sheet presence/absence detection sensor 23*b* being in an on-state at this point means that sheets S of an almost full amount are stacked on the sheet stack tray 17 and that the uppermost sheet S is located between the sheet presence/absence detection position L1 and the sheet height detection position L2. In such case, the rotation number of the lift motor 24 is low because of a large amount of the sheets S, so that the sheets can be stopped at an approximately optimum height even by terminating the drive of the lift motor 24 at a timing when the sheet height detection sensor 23*a* is turned on.

In case the sheet presence/absence detection sensor 23*b* is off in the step S103, the lift motor 24 is activated to move up the sheet stack tray 17. Then the sheet presence/absence detection sensor 23*b* detects whether the sheet S is present (step S104).

Figure 7:
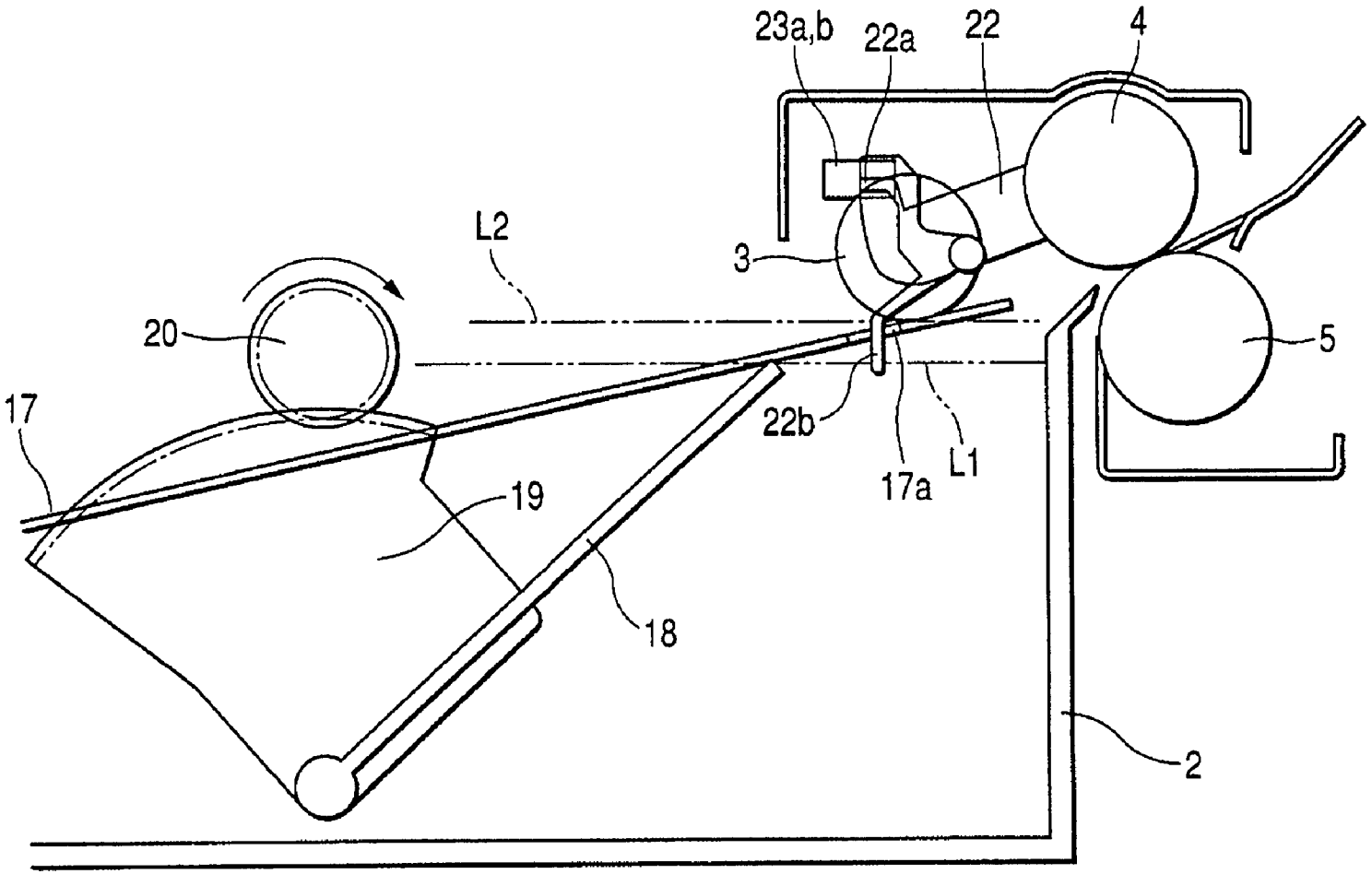
FIG. 7 is a cross-sectional view showing a sheet height detection mechanism and a sheet presence/absence detection mechanism.

In case the sheet presence/absence detection sensor 23*b* is off in the step S104, the lift motor 24 is activated, and the sheet height detection sensor 23*a* detects the sheet height (step S105). In case the sheet height detection sensor 23*a* is turned on, the lift motor 24 is stopped and absence of sheet is notified (step S106). In the absence of the sheet S on the sheet stack tray 17, the sheet presence/absence flag 22*b* does not pivot as the lower end thereof enters the Through hole 17*a* of the sheet stack tray 17, so that the sheet presence/absence detection sensor 23*b* remains in the off-state. On the other hand, the pickup roller 3 is pushed up by the sheet stack tray 17, thereby pivoting clockwise about the feed roller 4. Therefore the sheet height detection flag 22*a* of the pickup arm 22 intercepts the light to the sheet height detection sensor 23*a*, which is thus turned on (cf. FIG. 7). The absence of sheet is notified to the user by displaying, on the display panel D shown in FIG. 1, a message that no sheet is present on the sheet stack tray 17.

When the sheet height detection sensor 23*a* is in the off-state, the lift motor 24 is activated.

In case the sheet presence/absence detection sensor 23*b* is turned on in the step S104, the lift motor 24 is stopped. Then the lift motor 24 is maintained in the stopped state for a predetermined time (step S107). In the present embodiment, a period of maintaining such stopped state is selected as a period required by the rotation of the lift motor 24 to completely stop. It can be selected, for example, as a period required by the rotation of the lift motor 24 to completely stop in a state where the sheet stack amount is smallest or the sheet is not stacked.

Subsequently, the sheet height detection sensor 23*a* detects the sheet height (step S108). In case the sheet height detection sensor 23*a* is in the on-state, the sheet feeding can be executed while the lift motor 24 remains stopped. In case the sheet height detection sensor 23*a* is in the off-state, the lift motor 24 is so activated again as to move up the sheet stack tray 17.

These controls are executed by the control part 30, which control the lift motor 24 based on the detection results of the sheet height detection sensor 23*a* and the sheet presence/absence detection sensor 23*b*.

As explained in the foregoing control, the lift motor 24 is tentatively stopped at the sheet presence/absence detection position L1 which is lower than the sheet height detection position L2, and, after the tentative stop, the lift motor 24 is driven again so as to move up the sheet stack tray 17 to the position where the sheet height detection sensor 23*a* is turned on. Thus, the sheet S can be maintained at a constant height even when only a small amount of sheets S is stacked on the sheet stack tray 17, thereby enabling a stable sheet feeding.

Thus, even when the lift motor 24 is driven with a rotation number inducing an overrun in the drive to the sheet presence/absence detection position L1, such overrun can be prevented by tentatively stopping the lift motor 24 at the sheet presence/absence detection position L1, and such tentative stop can be utilized to move up the sheet stack tray 17 to the sheet height detection position.

Also in case of stopping the sheet stack tray 17 at the sheet presence/absence detection position L1 and then driving the lift motor 24 again to move up the sheet stack tray 17 to the sheet height detection position L2, it is possible to stop the lift motor 24 before the rotation number of the lift motor 24 increases to a level inducing an overrun, thereby preventing an overrun of the sheet stack tray 17 and enabling a stable sheet feeding.

In the embodiment explained above, the lift motor 24 is tentatively stopped when the sheet presence/absence detection sensor 23*b* detects a sheet at the sheet presence/absence detection position L1 for detecting the uppermost sheet. It is however also possible to control the lift motor 24 so as to decelerate the sheet stack tray 17, when the sheet presence/absence detection sensor 23*b* detects a sheet at the sheet presence/absence detection position L1 for detecting the uppermost sheet. Then, after such deceleration of the sheet stack tray 17, it is moved up until the sheet height detection sensor 23*a* detects that the uppermost sheet has reached the sheet height detection position L2 which is the feed position.

This application claims priority from Japanese Patent Application No. 2005-152755 filed May 25, 2005, which is hereby incorporated by reference herein.

What is claimed is:

1. A sheet feeding apparatus comprising:

a sheet stack tray on which sheets are stacked;

a drive unit configured to move said sheet stack tray up;

a feeding unit configured to feed an uppermost sheet of the sheets stacked on said sheet stack tray at a feeding position;

a first sensor configured to sense the uppermost sheet of the sheets stacked on said sheet stack tray or said sheet stack tray at the feeding position;

a second sensor configured to sense the uppermost sheet of the sheets stacked on said sheet stack tray at a position which is lower than the feeding position; and a control part configured to effect a temporary stop or a speed reduction of said drive unit according to sensing of the second sensor while the drive unit moves said sheet stack tray up, and after the temporary stop or the speed reduction, said control part controls said drive unit to move said sheet stacking tray up until the first sensor detects the uppermost sheet at the feeding position, wherein the control part determines that a sheet is not present on the sheet stack tray in a case where the second sensor does not sense the uppermost sheet and the first sensor detects the sheet stack tray.

2. A sheet feeding apparatus according to claim 1, wherein said control part effects the temporary stop of the drive unit according to the sensing of the second sensor and, after the temporary stop, re-drives the drive unit so as to move up the sheet stack tray until the first sensor detects that the uppermost sheet reaches the feeding position, but does not re-drive the drive unit in case, when the temporary stop of the drive unit has been performed, the uppermost sheet reaches the feeding position.

3. A sheet feeding apparatus according to claim 1, wherein said control part effects a the temporary stop of the drive unit when the second sensor senses that the uppermost sheet is situated at the position lower than the feeding position, and after maintaining the drive unit in the stopped state for a predetermined period, re-drives the drive unit to move up the sheet on the sheet stack tray to the feeding position.

4. A sheet feeding apparatus according to claim 3, wherein the predetermined period is a period required by the drive unit to completely stop.

5. A sheet feeding apparatus according to claim 1, wherein the sheet stack tray is provided in a sheet cassette detachably mounted in a main body of an apparatus; and in case, when the sheet cassette is mounted on the main body of the apparatus, the second sensor senses that the uppermost sheet is situated at a position higher than the position, the control part controls the drive unit so as to move the sheet on the sheet stack tray to the feeding position.

6. A sheet feeding apparatus according to claim 1, further comprising:

a detection flag of which a position is detected by the second sensor and which is moved in contact with the uppermost sheet on the sheet stack tray, wherein the detection flag, in the presence of a sheet on the sheet stack tray, comes into contact with the sheet when the uppermost sheet becomes positioned higher than the position by a move-up of the sheet stack tray thereby being so moved as to switch an on/off state of the second sensor, but, in the absence of a sheet on the sheet stack tray, does not move so as to switch the on/off state of the second sensor when the sheet stack tray is moved up;

a height detection flag moved in contact with the uppermost sheet on the sheet stack tray or an upper surface of the sheet stack tray thereby switching an on/off state of the first sensor, wherein the height detection flag, in the presence of a sheet on the sheet stack tray, comes into contact with the sheet when the uppermost sheet reaches the feeding position by a move-up of the sheet stack tray thereby being so moved as to switch an on/off state of the first sensor, but, in the absence of a sheet on the sheet stack tray, comes into contact with the sheet stack tray thereby switching an on/off state of the first sensor; and a notifying part for notifying absence of a sheet on the sheet stack tray, in case the on/off state of the second sensor does not change but the on/off state of the first sensor changes by moving the sheet stack tray up.

* * * * *